US008220104B1

(12) United States Patent
Chu

(10) Patent No.: US 8,220,104 B1
(45) Date of Patent: Jul. 17, 2012

(54) MOP FABRIC SNAP-IN CONNECTION STRUCTURE

(76) Inventor: Shu-Hsun Chu, Guangdong Province (CN)

( * ) Notice: Subject to any disclaimer, the term of this patent is extended or adjusted under 35 U.S.C. 154(b) by 0 days.

(21) Appl. No.: 13/074,145

(22) Filed: Mar. 29, 2011

(51) Int. Cl.
*A47L 13/20* (2006.01)

(52) U.S. Cl. ..... 15/228; 15/144.1; 15/144.2; 15/229.6

(58) Field of Classification Search ..... 15/228, 15/229.6, 144.1, 144.2, 260; *A47L 13/20*
See application file for complete search history.

(56) References Cited

U.S. PATENT DOCUMENTS

2008/0307598 A1* 12/2008 Lin ..... 15/229.1
* cited by examiner

*Primary Examiner* — Monica Carter
*Assistant Examiner* — Stephanie Newton
(74) *Attorney, Agent, or Firm* — Rosenberg, Klein & Lee

(57) ABSTRACT

A mop fabric snap-in connection structure comprises: a disc having a groove formed around the bottom of the disc, and a plurality of first snap-in connection structures arranged in the groove; a plurality of mop fabrics, disposed across a surface of the groove; and a pressing member, installed at the bottom of the disc, and a main body of the pressing member having a plurality of second snap-in connection structures corresponding to and latched each other with the first snap-in connection structures of the groove respectively. The present invention engages two modules including the disc and the pressing member with the mop fabrics 80 into an M-shape by the mutual and alternate engagement, and the method of latching and fixing the two modules achieves a convenient assembling and a secured clamping, and prevents the fabrics from falling out easily without requiring any locking components.

5 Claims, 10 Drawing Sheets

MOP FABRIC SNAP-IN CONNECTION STRUCTURE

BACKGROUND OF THE INVENTION (a) Field of the Invention

The present invention relates to a mop fabric snap-in connection structure, and more particularly to a mop fabric fixture without requiring any locking component.

(b) Description of the Related Art

A mop is a necessary cleaning tool in our daily life, and the mop mainly uses cotton strips (or mop fabric) installed at a mop head to achieve the effect of absorbing dirty substances or liquids to clean the floor.

At early stage, a bunch of cotton strips are combined and fixed to a circular plastic head of a conventional mop head, or a plurality of cotton strips are arranged and fixed to a rectangular plastic or wood block. Regardless of the circular plastic head or a rectangular mop, the cotton strips cannot be spread open easily, and the cleaning effect is limited.

Therefore, related manufacturers developed a circular disc rotating mop head, wherein the mop head installed at the bottom of a rod can be rotated in 360 degrees, and the cotton strips are arranged in a circular shape and fixed to the bottom of a circular frame. Such circular disc mop head definitely can provide the cleaning effect and improve the practical application, but the conventional circular disc mop head as shown in FIGS. 1A and 1B includes a circular frame 10 and a plurality of installing holes 11 predetermined on the circular frame 10. In FIGS. 1C and 1D, an end 21 of cotton strip 20 is implanted into the installing hole 11 by tool manually or semi-automatically. Such manufacturing method not only takes much time and efforts, but also incurs a high manufacturing cost and a low production capacity. Further, the implant method used for combining the cotton strip 20 with the circular frame 10 may result in an unsecured connection. Furthermore, when the circular disc mop head is rotated continuously during use, the cotton strips may fall out easily, thus not only lowering the quality and damaging the mop quickly, but also shortening the using life. Obviously, the conventional circular disc mop head still requires improvements.

With reference to FIG. 2 for Taiwan Pat. No. M377955, entitled "Mop fabric fixing assembly", the patent discloses an assembly comprising: a fixing ring 30 having a groove 31 disposed around the fixing ring 30, and a positioning pillar 32 formed in the groove 31; a plurality of mop fabrics 40, disposed across the groove 31 of the fixing ring 30; a disc 50, combined with the fixing ring 30 by a screw 51, for pressing and fixing the mop fabrics 40.

In the foregoing patent, the mop fabrics 40 are fixed by using the screws 51, such that when it is necessary to replace the mop fabrics 40, users have to remove the screw 51, and the application is inconvenient. Furthermore, the stability of clamping the mop fabrics 40 by the fixing ring 30 and the disc 50 is low, and thus the mop fabrics 40 may fall out easily, and the using life of the mop is affected adversely. Obviously, the conventional mop fabric fixing assembly requires improvements.

SUMMARY OF THE INVENTION

Therefore, it is a primary objective of the present invention to provide a mop fabric snap-in connection structure capable of clamping and positioning the mop fabrics conveniently and stably without requiring any locking component, so as to achieve the effect of preventing the mop fabrics from falling out easily.

In order to achieve the above-mentioned objects, the invention includes:

a) a disc, having a groove formed around the bottom of the disc, and a plurality of first snap-in connection structures arranged in the groove, and any one of the first snap-in connection structures, comprising: two latch portions disposed in opposite directions to each other, and the latch portion having a guide oblique edge extended downwardly from the latch portion, and a latch surface formed at the top of the guide oblique edge; a convex ridge, disposed at the center of the bottom of the groove and at the middle between the two opposite latch portions, and the convex ridge having a height lower than the latch portion, and a plurality of serrations disposed at a ridgeline of the convex ridge;

b) a plurality of mop fabrics, disposed across a surface of the groove; and c) a pressing member, installed at the bottom of the disc, and having a main body with a plurality of second snap-in connection structures corresponsive to and connectible each other with the first snap-in connection structure of the groove respectively, and each of the second snap-in connection structures, comprising: two hooks, arranged substantially in opposite directions to each other, and each hook being corresponsive to the latch portion, passed through the guide oblique edge, and hooking the latch surface; and a U-shaped pressing member, having internal and external sides parallelly disposed between the two hooks, and the width between the internal and external sides of the U-shaped pressing member being greater than the width of the convex ridge, and a plurality of serrations disposed on both distal surfaces of the U-shaped pressing member respectively, such that when the second snap-in connection structure is embedded into the first snap-in connection structure, the hook is hooking the latch surface, and the U-shaped pressing member engages the mop fabric into the groove into an M-shape to form a mop fabric module quickly According to the invention, the first snap-in connection structure having an L-shaped positioning block disposed separately at four corners of the first snap-in connection structure, such that the four sides of the U-shaped pressing member are embedded into the internal edges of the L-shaped positioning block, and the first and second snap-in connection structures are aligned precisely and coupled with each other.

Furthermore, the mop fabric module is in a circular shape or a rectangular shape, and the mop fabric module is coupled to the bottom of a mop head in conjunction with a handle at the top of the mop head to form a mop.

DETAILED DESCRIPTION OF THE PREFERRED EMBODIMENT

Figure 1A:
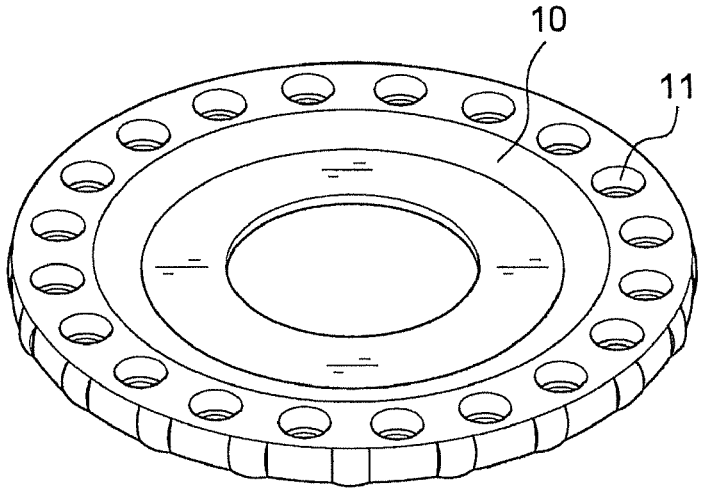
FIG.1A PRIOR ART
FIGS. 1A, 1B, 1C and 1D are schematic views of a conventional mop fabric assembly.
Figure 1B:
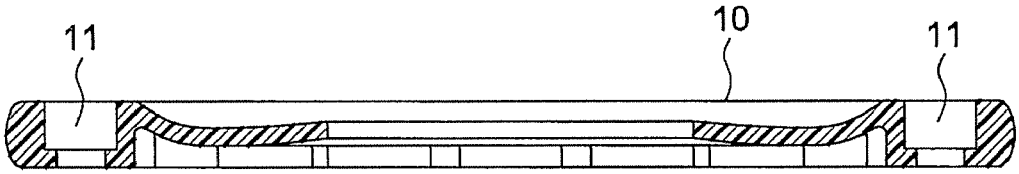
FIG.1B PRIOR ART
Figure 1C:
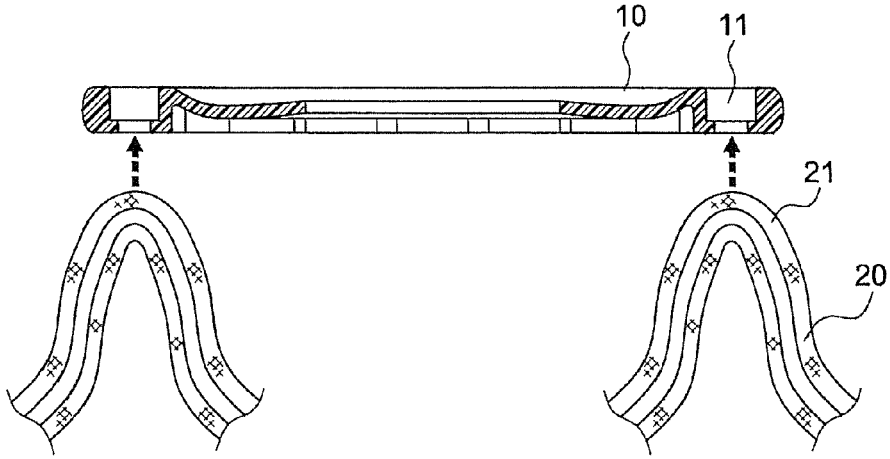
FIG.1C PRIOR ART
Figure 1D:
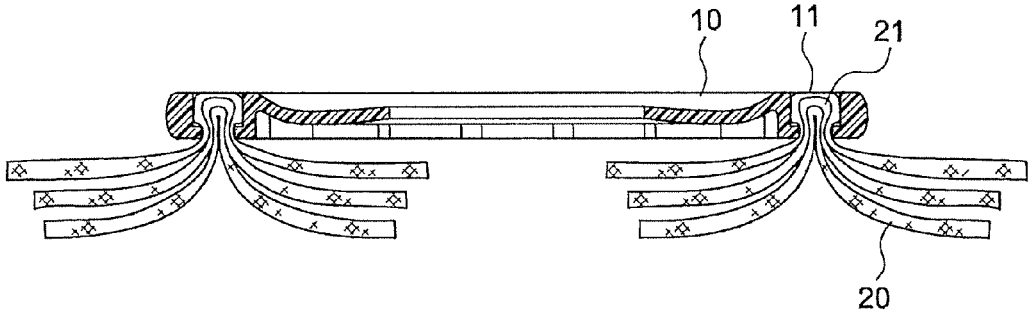
FIG.1D PRIOR ART
Figure 2:
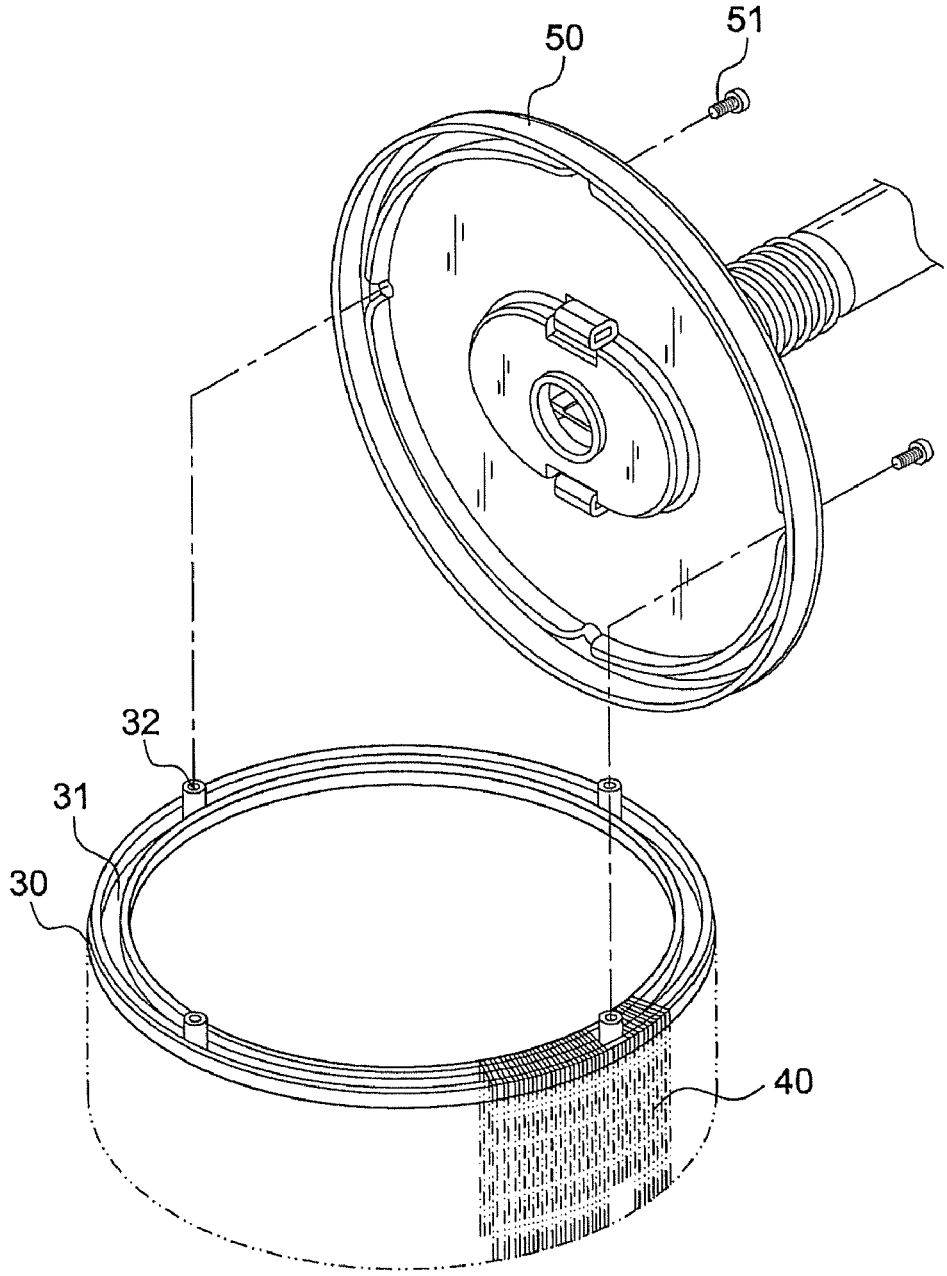
FIG.2 PRIOR ART
FIG. 2 is an exploded view of an assembly as disclosed in Taiwan Pat. No. M377955.
Figure 3:
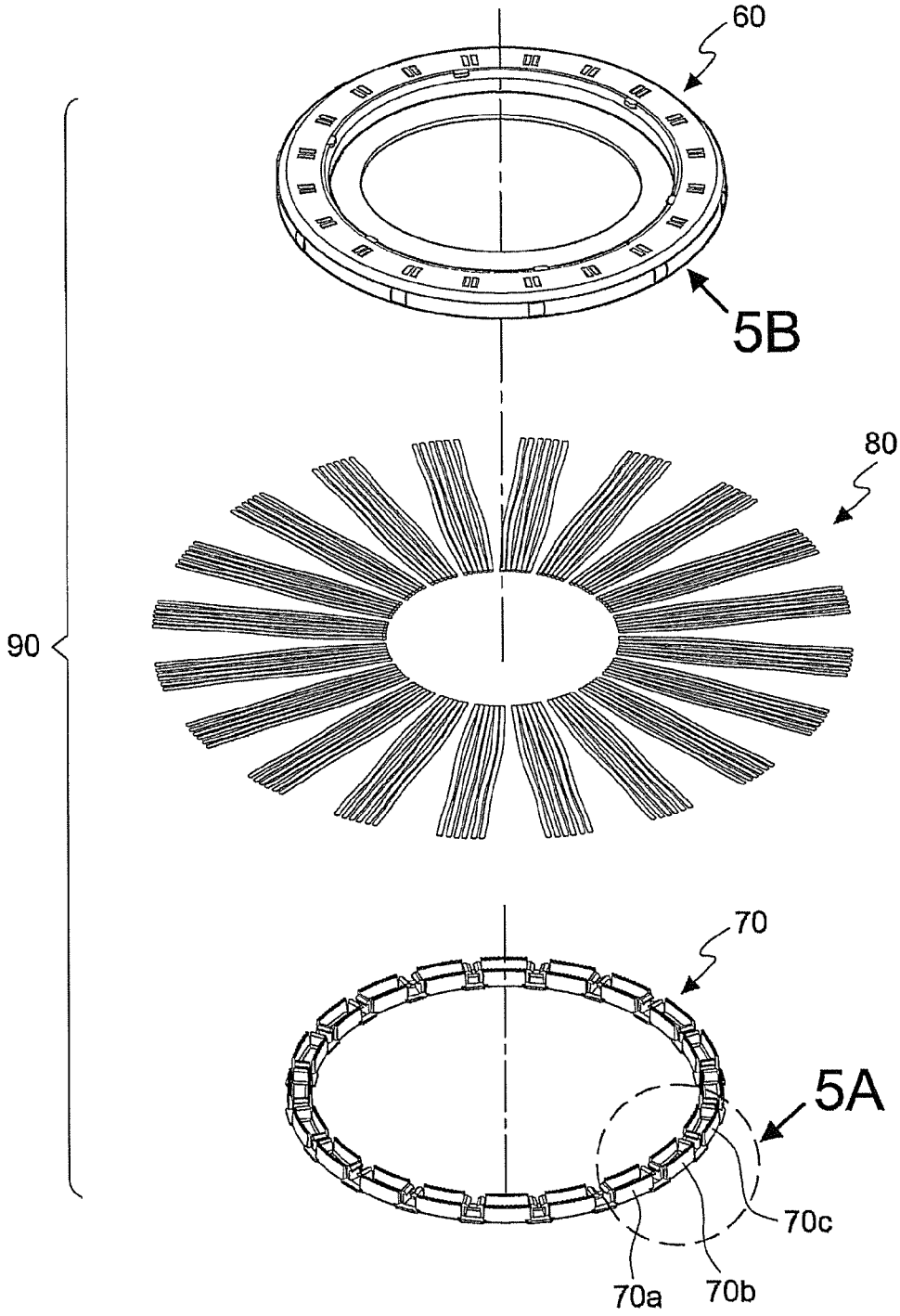
FIG. 3 is an exploded view of the present invention.
Figure 4:
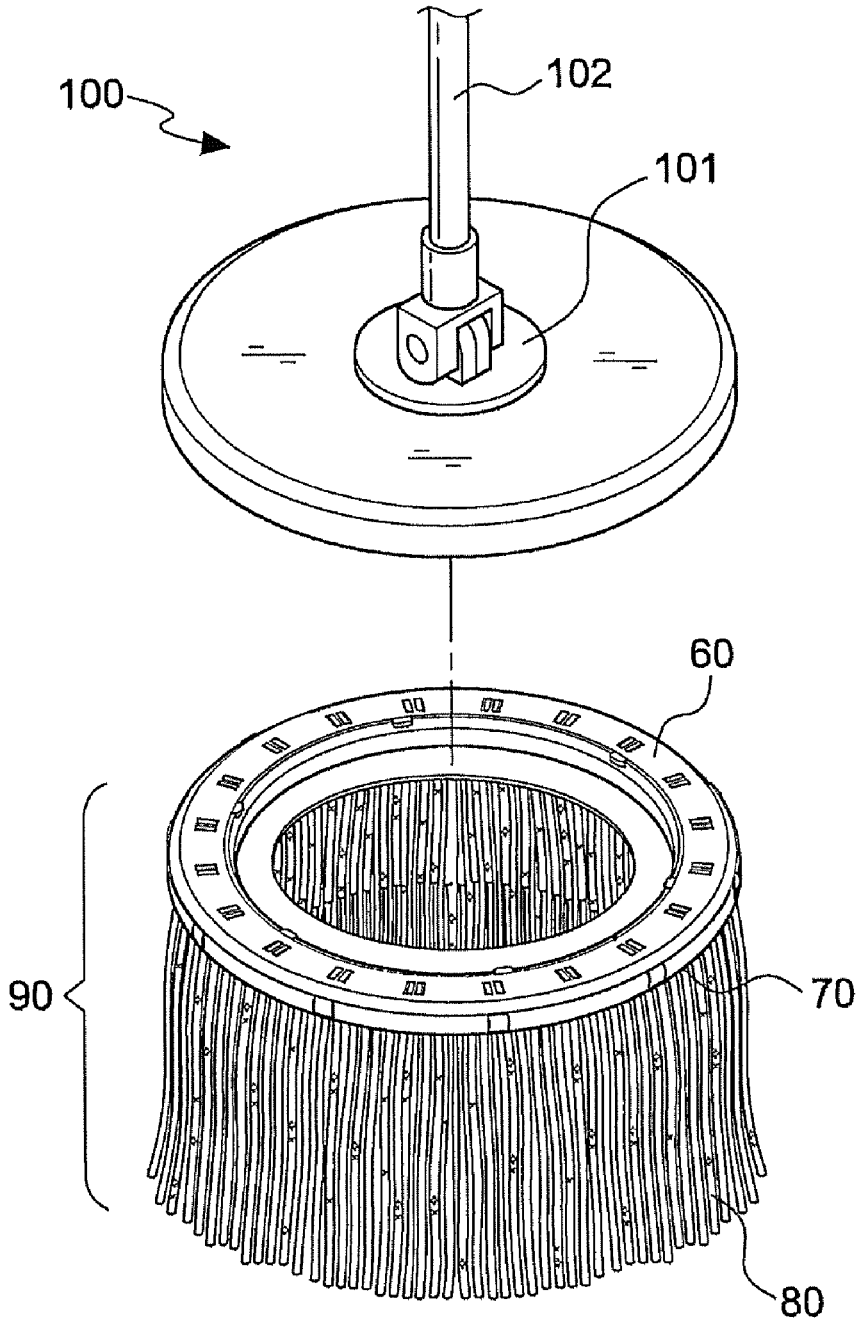
FIG. 4 is a perspective view of the present invention.

With reference to FIGS. 3 to 9 for a mop fabric snap-in connection structure in accordance with a preferred embodiment of the present invention, the mop fabric snap-in connection structure comprises:

a disc 60, having groove 65 formed around the bottom of the disc 60, and a plurality of first snap-in connection structure 60*a*, 60*b*, 60*c* arranged in the groove 65, and any one of the first snap-in connection structure, comprising:

two latch portions 61, disposed in opposite directions to each other, and each latch portion 61 having a guide oblique edge 611 extended downwardly from the latch portion 61, and a latch surface 612 formed at the top of the guide oblique edge 611;

a convex ridge 62, disposed at the center of the bottom of the groove 65 and in the middle between the two opposite latch portions 61, and having a height lower than the latch portions 61, and a plurality of serrations 63 formed on a ridgeline of the convex ridge 62;

a plurality of mop fabrics 80, disposed across a surface of the groove 65; and a pressing member 70, installed at the bottom of the disc 60, and a main body 75 of the pressing member 70 having a plurality of second snap-in connection structures 70*a*, 70*b*, 70*c* corresponsive to and connectible each other with the first snap-in connection structure 60*a*, 60*b*, 60*c* of the groove 65 respectively, and each of the second snap-in connection structures, comprising:

two hooks 71 disposed in opposite directions to each other, and corresponsive to the latch portion 61, passed through the guide oblique edge 611 and hooking the latch surface 612;

a U-shaped pressing member 72, with internal and external sides parallelly disposed between the two hooks 71, and the width D between the internal and external sides of the U-shaped pressing member 72 being greater than the width d of the convex ridge 62, and having a plurality of serrations 73 on both distal surfaces, such that when the second snap-in connection structure is embedded into the first snap-in connection structure, the hook 71 is hooking the latch surface 612, and the U-shaped pressing member 72 clamping and engaging the mop fabric 80 into the groove 65 in an M-shape to assemble a mop fabric module 90 quickly.

Figure 5A:
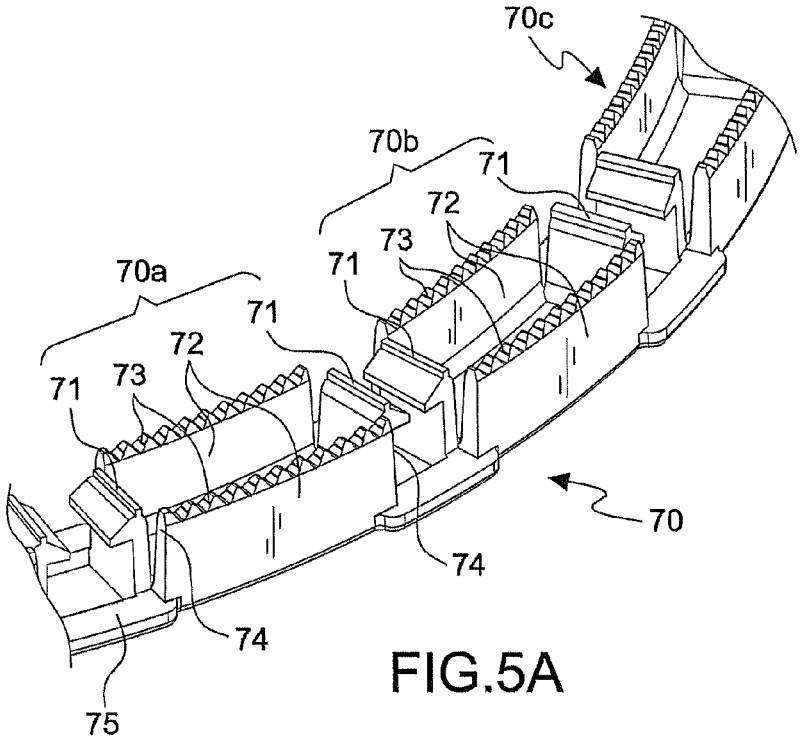
FIG. 5A is an enlarged view of the portion 5A of FIG. 3.
Figure 5B:
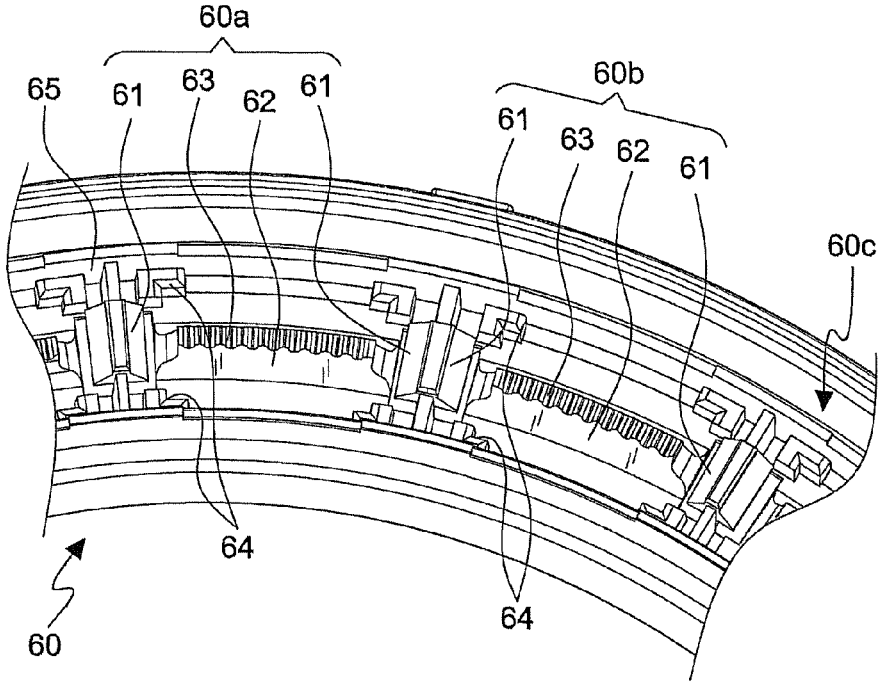
FIG. 5B is an enlarged view of the portion in a direction as indicated by 5B of FIG. 3.
Figure 5C:
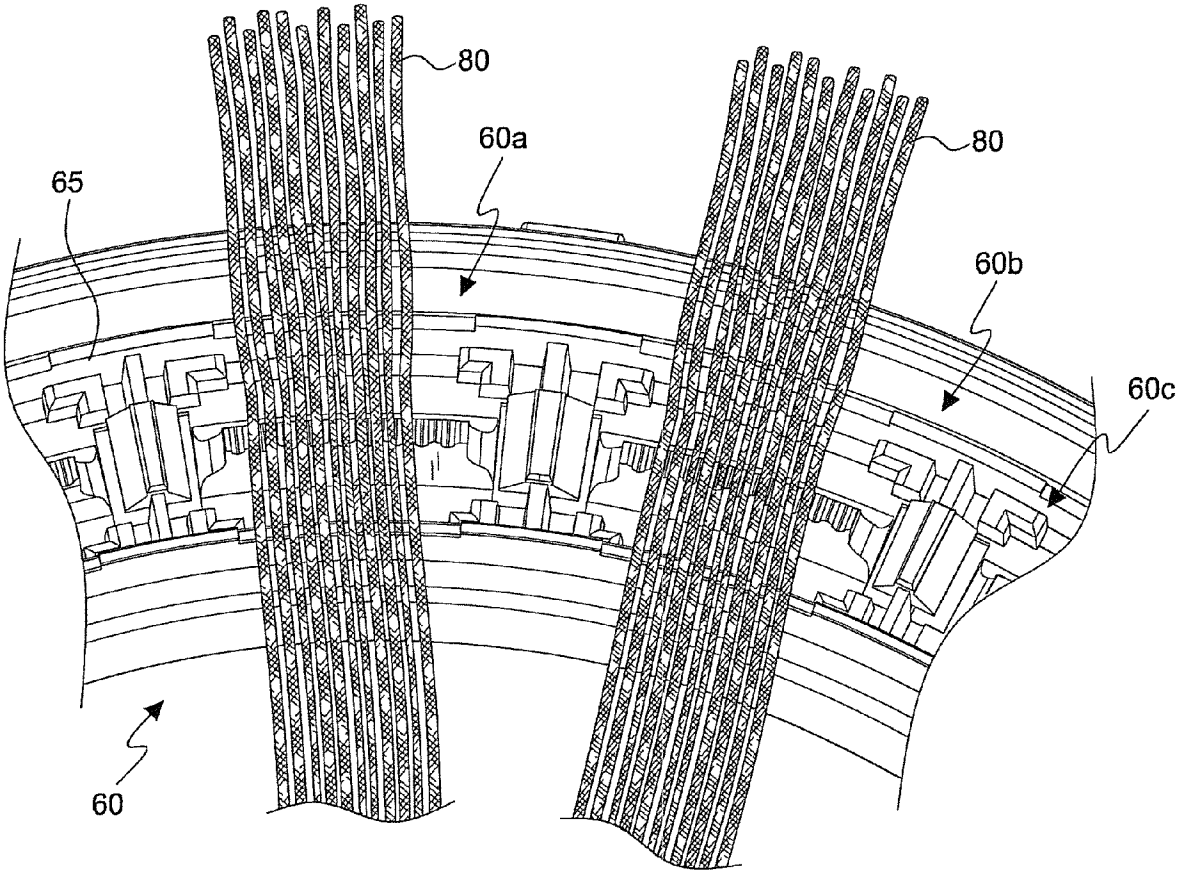
FIG. 5C is a schematic view of mop fabrics disposed onto a disc.
Figure 6A:
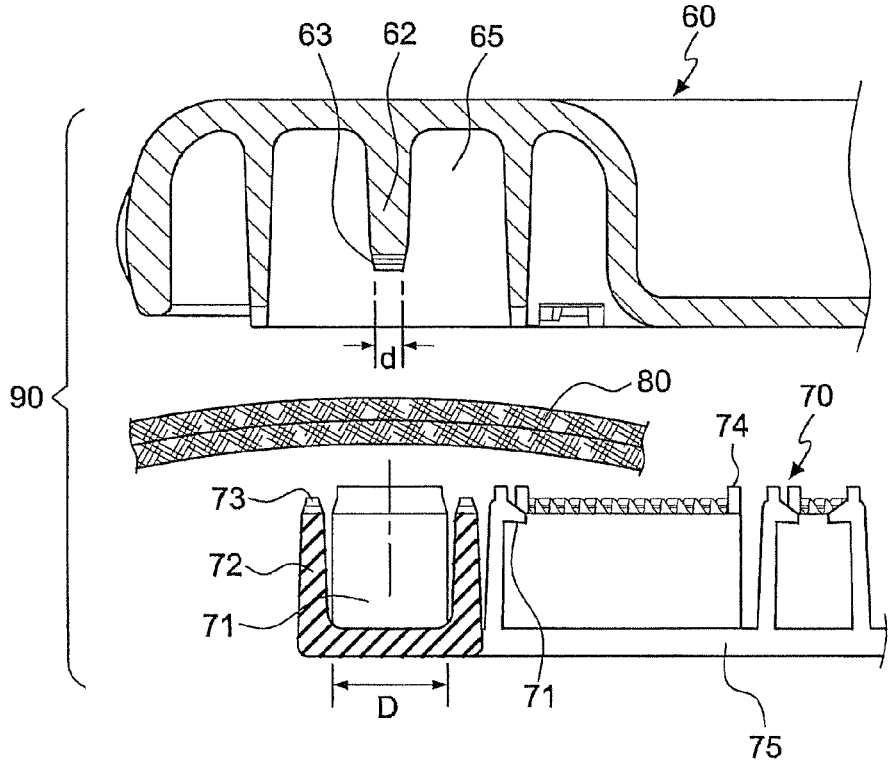
FIG. 6A is a cross-sectional exploded view of the main structure of the present invention.
Figure 6B:
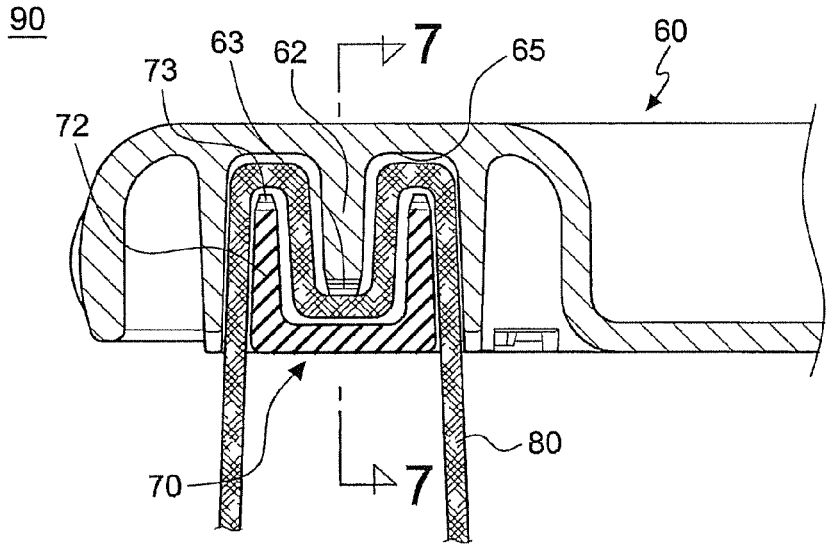
FIG. 6B is a cross-sectional assembled view of the main structure of the present invention.

In this preferred embodiment as shown in FIG. 5C, the way of assembling the mop fabrics 80 is to mount the mop fabrics 80 onto each first snap-in connection structure 60*a*, 60*b* . . . , and then embed the second snap-in connection structure 70*a*, 70*b* . . . of the pressing member 70 into the disc 60 to assemble a mop fabric module 90 quickly.

In this preferred embodiment as shown in FIGS. 5A and 5B, L-shaped positioning blocks 64 are disposed at four corners of the first snap-in connection structure 60*a*, 60*b* . . . respectively, such that the four sides 74 of the U-shaped pressing member 72 are embedded into the internal side of the L-shaped positioning block 64, such that the first and second snap-in connection structures 60*a*, 70*a*, 60*b*, 70*b* are aligned precisely and coupled to each other.

Figure 7:
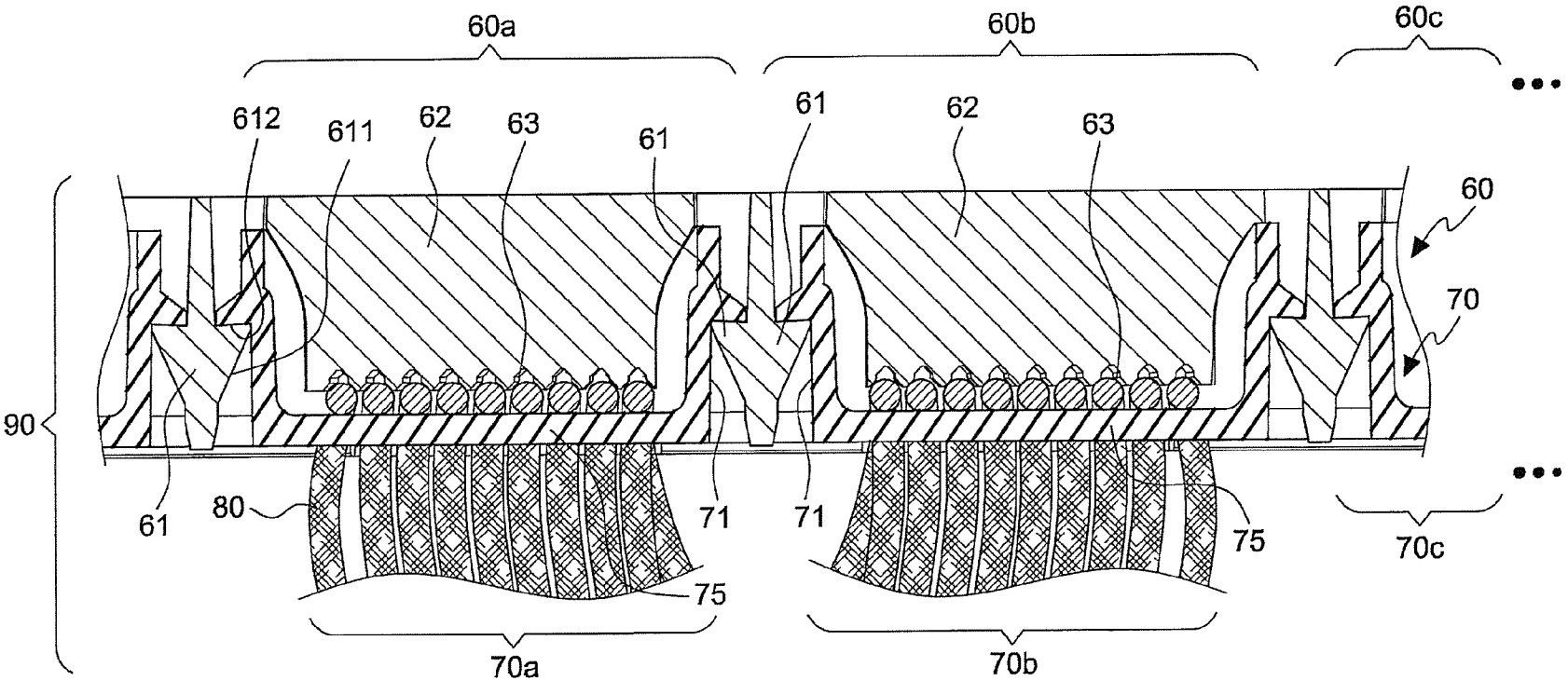
FIG. 7 is a cross-sectional view of Section 7-7 of FIG. 6B.

In this preferred embodiment as shown in FIG. 7, the latch portion 61 of one first snap-in connection structure 60*a* is arranged in an opposite direction to and integrally formed with the latch portion 61 of another first snap-in connection structure 60*b*. However, the present invention is not limited to such arrangement only.

The pressing member 70 of the present invention is designed in a shape matched with the shape of the disc 60, such as a circular, arc or linear shape, and the second snap-in connection structure 70*a* . . . on the pressing member 70 is embedded into and latched with the first snap-in connection structure 60*a* . . . of the disc 60 to engage the mop fabrics 80.

Figure 8:
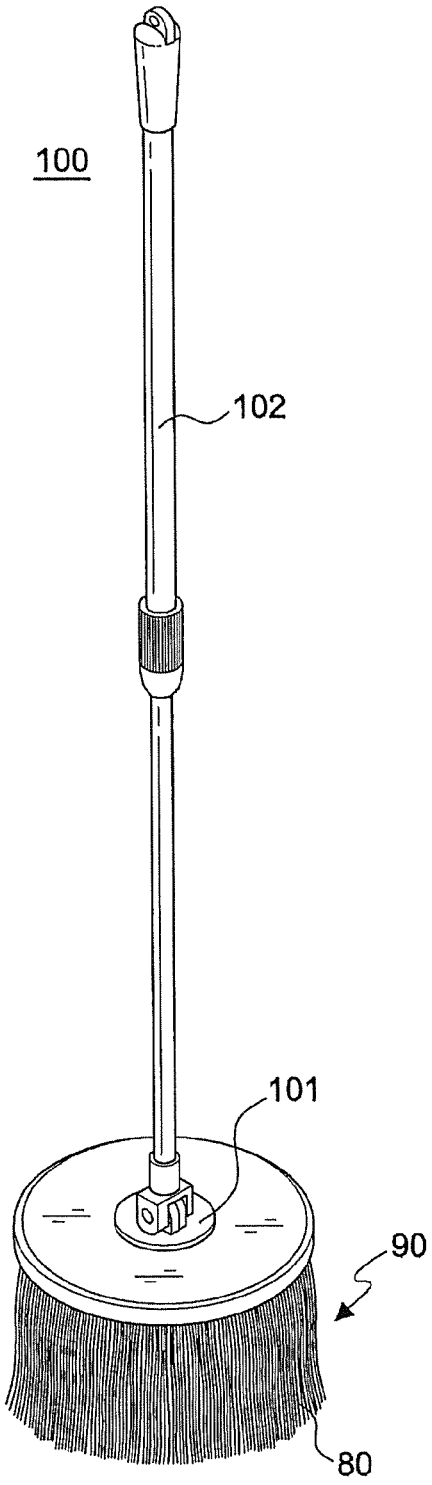
FIG. 8 is a schematic view of a first application of the present invention.
Figure 9:
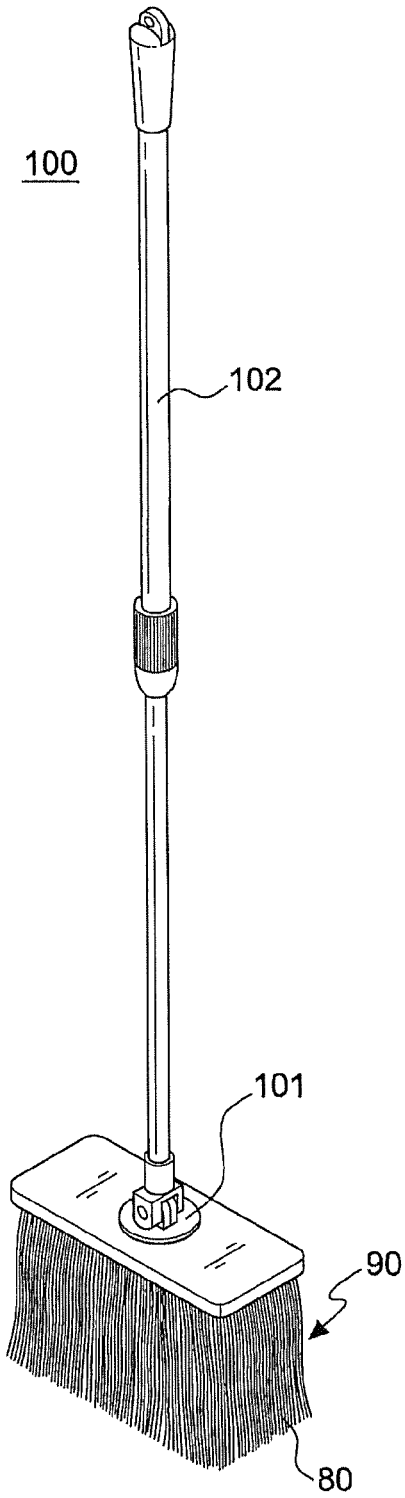
FIG. 9 is a schematic view of a second application of the present invention.

In the aforementioned assembly, the mop fabric module 90 of the present invention is designed with a circular shape as shown in FIG. 8 or a rectangular shape as shown in FIG. 9, and the mop fabric module 90 is combined with the bottom of the mop head 101 in conjunction with a handle 102 at the top of the mop head 101 to form a mop 100. The shape and size of the mop fabric module 90 of the present invention can be designed to be compatible with the mop head 101 available in the market, so as to make the replacement easy and convenient.

The present invention is characterized in that two modules including the disc 60 and the pressing member 70 are engaged with the mop fabrics 80 into an M-shape by the mutual and alternate engagement, and the method of latching and fixing the two modules achieves a convenient assembling and a secured clamping and prevents the fabrics from falling out easily without requiring any locking component.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A mop fabric snap-in connection structure, comprising:

a) a disc, having a groove formed around the bottom of the disc, and a plurality of first snap-in connection structures arranged in the groove, and any one of the first snap-in connection structures, comprising:

two latch portions disposed in opposite directions to each other, and the latch portion having a guide oblique edge extended downwardly from the latch portion, and a latch surface formed at the top of the guide oblique edge;

a convex ridge, disposed at the center of the bottom of the groove and at the middle between the two opposite latch portions, and the convex ridge having a height lower than the latch portion, and a plurality of serrations disposed at a ridgeline of the convex ridge;

b) a plurality of mop fabrics, disposed across a surface of the groove; and c) a pressing member, installed at the bottom of the disc, and having a main body with a plurality of second snap-in connection structures corresponsive to and connectible each other with the first snap-in connection structure of the groove respectively, and each of the second snap-in connection structures, comprising:

i) two hooks, arranged substantially in opposite directions to each other, and each hook being corresponsive to the latch portion, passed through the guide oblique edge, and hooking the latch surface; and ii) a U-shaped pressing member, having internal and external sides parallelly disposed between the two hooks, and the width between the internal and external sides of the U-shaped pressing member being greater than the width of the convex ridge, and a plurality of serrations disposed on both distal surfaces of the U-shaped pressing member respectively, such that when the second snap-in connection structure is embedded into the first snap-in connection structure, the hook is hooking the latch surface, and the U-shaped pressing member engages the mop fabric into the groove into an M-shape to form a mop fabric module quickly.

2. The mop fabric snap-in connection structure as recited in claim 1, wherein the first snap-in connection structure having an L-shaped positioning block disposed separately at four corners of the first snap-in connection structure, such that the four sides of the U-shaped pressing member are embedded into the internal edges of the L-shaped positioning block, and the first and second snap-in connection structures are aligned precisely and coupled with each other.

3. The mop fabric snap-in connection structure as recited in claim 2, wherein the first snap-in connection structure has one latch portion integrally formed and arranged in an opposite direction with the other latch portion of the first snap-in connection structure.

4. The mop fabric snap-in connection structure as recited in claim 3, wherein the mop fabric module is in a circular shape or a rectangular shape.

5. The mop fabric snap-in connection structure as recited in claim 4, wherein the mop fabric module is coupled to the bottom of a mop head in conjunction with a handle at the top of the mop head to form a mop.

* * * * *